US006606894B1

(12) United States Patent
Wu

(10) Patent No.: US 6,606,894 B1
(45) Date of Patent: Aug. 19, 2003

(54) TRANSMISSION MECHANISM FOR SPRING WINDING MACHINE

(76) Inventor: David Wu, P.O. Box 26-757, Taipei (TW)

( * ) Notice: Subject to any disclaimer, the term of this patent is extended or adjusted under 35 U.S.C. 154(b) by 0 days.

(21) Appl. No.: 10/138,904

(22) Filed: Apr. 30, 2002

(51) Int. Cl.[7] ..... B21E 35/02

(52) U.S. Cl. ..... 72/137; 72/449; 74/813 R; 74/813 L

(58) Field of Search ..... 72/137, 138, 135, 72/142, 449; 74/416, 417, 423, 813 R, 813 L

(56) References Cited

U.S. PATENT DOCUMENTS 5,363,681 A * 11/1994 Speck et al. ..... 72/129
5,657,657 A * 8/1997 Welsh et al. ..... 72/139
5,706,687 A * 1/1998 Welsh et al. ..... 72/138
6,151,942 A * 11/2000 Itaya ..... 72/137

* cited by examiner

*Primary Examiner*—Allen Ostrager
*Assistant Examiner*—John S Goetz
(74) *Attorney, Agent, or Firm*—Rosenberg, Klein & Lee

(57) ABSTRACT

A transmission mechanism used in a spring winding machine is constructed to include a rotary table, the rotary table having an eccentric main shaft protruded over first and second sides thereof. A wire feeding box having an intermediate gear, a transfer cylinder set formed of a wire-transfer cylinder and an impression cylinder adapted for transferring a spring wire for processing, a spur gear coaxially connected to the wire-transfer cylinder and meshed with the intermediate gear, a first bevel gear fixedly mounted on the other end of the main shaft, a second bevel gear coaxially connected to the intermediate gear, a wire feeding motor installed in the first side of the rotary table and adapted for rotating the driven gear and the main shaft, and a reversible wire winding motor adapted for rotating the rotary table clockwise/counter-clockwise through 180° through a transmission belt.

2 Claims, 3 Drawing Sheets

TRANSMISSION MECHANISM FOR SPRING WINDING MACHINE

BACKGROUND OF THE INVENTION

1. Field of the Invention

The present invention relates to a spring winding machine and, more specifically, to a transmission mechanism for spring winding machine, which enables wire feeding and wire winding to be operated programmably independently without considering any compensation with respect to wire winding and feeding actions.

2. Description of the Prior Art

Various spring winding machines have been disclosed for processing spring wires into springs or the like. U.S. Pat. No. 5,363,831 discloses an exemplar. According to this design, the spring winding machine uses a first servomotor, a second servomotor to turn a belt transmission mechanism and to further move a spring wire forwards and wind the moving spring wire. This design of spring winding machine enables wire feeding and wire winding actions to be simultaneously performed to short spring processing time. However, because it requires high torsional force to rotate the belt transmission mechanism, the capacity of the servomotors is relatively high. In consequence of the use of high capacity servomotors, the spring winding machine is bulky and heavy. Further, regular spring winding machines commonly use spring wires of caliber within 2 mm for making springs. It is not economic to install high capacity motors in a spring winding machine to feed and wind spring wires.

Further, conventional spring winding machines are capable of processing spring wires of different calibers into springs, i.e., a spring winding machine fits spring wires of different calibers. In order to meet this wide application range, the capacity of the motors should be sufficient for moving and winding a full range of spring wires. However, it is not economic to use high capacity motors in a spring winding machine to move and wind a thin spring wire.

In the aforesaid spring winding machine according to U.S. Pat. No. 5,363,681, the coupling structure between the servomotors and movable parts of the spring winding machine is complicated. It is also complicated to maintain the coupling structure. Because wire winding action is performed during wire feeding action, it is necessary to control reversing operation of the servomotor to stop the spring wire from rushing out. Furthermore, because wire winding action and wire feeding action are simultaneously executed, it is difficult to achieve "synchronous control" accurately, resulting in low yielding rate.

SUMMARY OF THE INVENTION

The present invention has been accomplished to provide a transmission mechanism for spring winding machine, which eliminates the aforesaid drawbacks. It is one object of the present invention to provide a transmission mechanism for spring winding machine, which requires less installation space. It is another object of the present invention to provide a transmission mechanism for spring winding machine, which is convenient for maintenance and practical for program control without considering any compensation with respect to wire winding and feeding actions. It is still another object of the present invention to provide a transmission mechanism for spring winding machine, which is inexpensive to manufacture. To achieve these and other objects of the present invention, the transmission mechanism for spring winding machine comprises a rotary table, the rotary table having an eccentric main shaft protruded over first and second sides thereof and a driven gear at one end of the main shaft, a wire feeding box fixedly mounted on the second side of the rotary table, the wire feeding box having an intermediate gear, a transfer cylinder set formed of a wire-transfer cylinder and an impression cylinder adapted for transferring a spring wire for processing, a spur gear coaxially connected to the wire-transfer cylinder and meshed with the intermediate gear, a first bevel gear fixedly mounted on the other end of the main shaft, a second bevel gear coaxially connected to the intermediate gear and meshed with the first bevel gear, a wire feeding motor installed in the first side of the rotary table and adapted for rotating the driven gear and the main shaft, and a reversible wire winding motor adapted for rotating the rotary table clockwise/counter-clockwise through 180° through a transmission belt.

DETAILED DESCRIPTION OF THE PREFERRED EMBODIMENT

Figure 1:
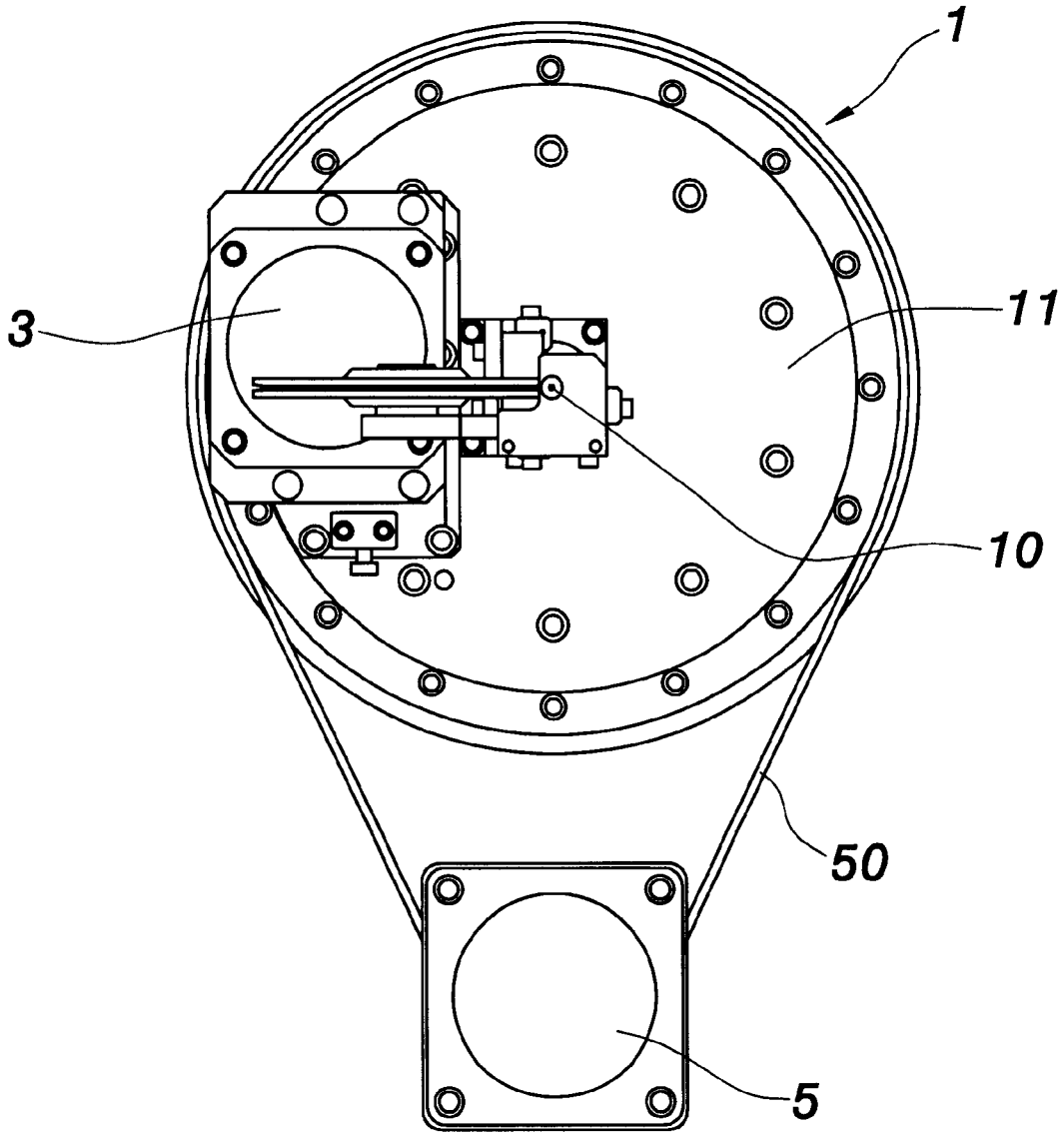
FIG. 1 is a front view of the preferred embodiment of the present invention.
Figure 2:
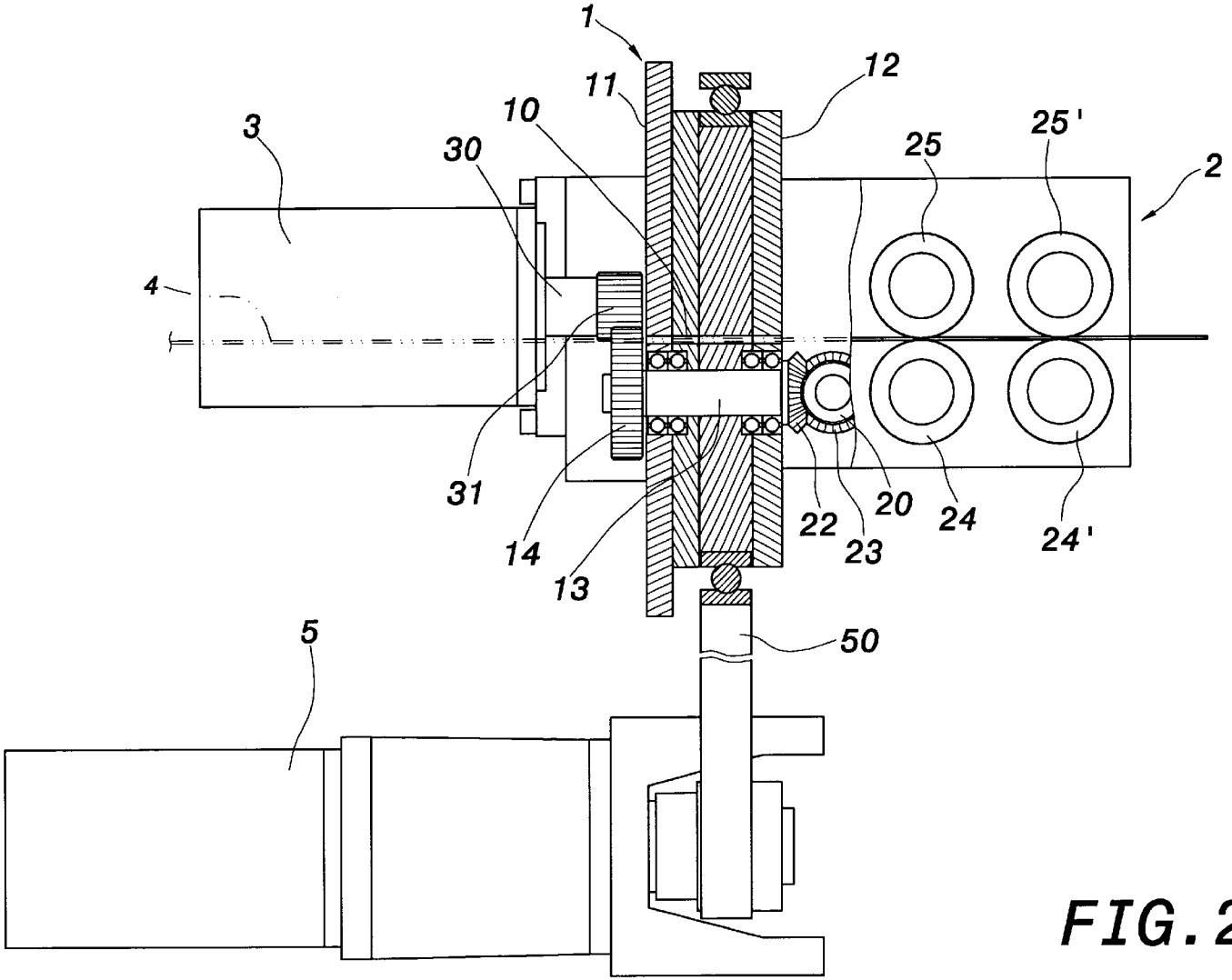
FIG. 2 is a sectional right side view of the preferred embodiment of the present invention.
Figure 3:
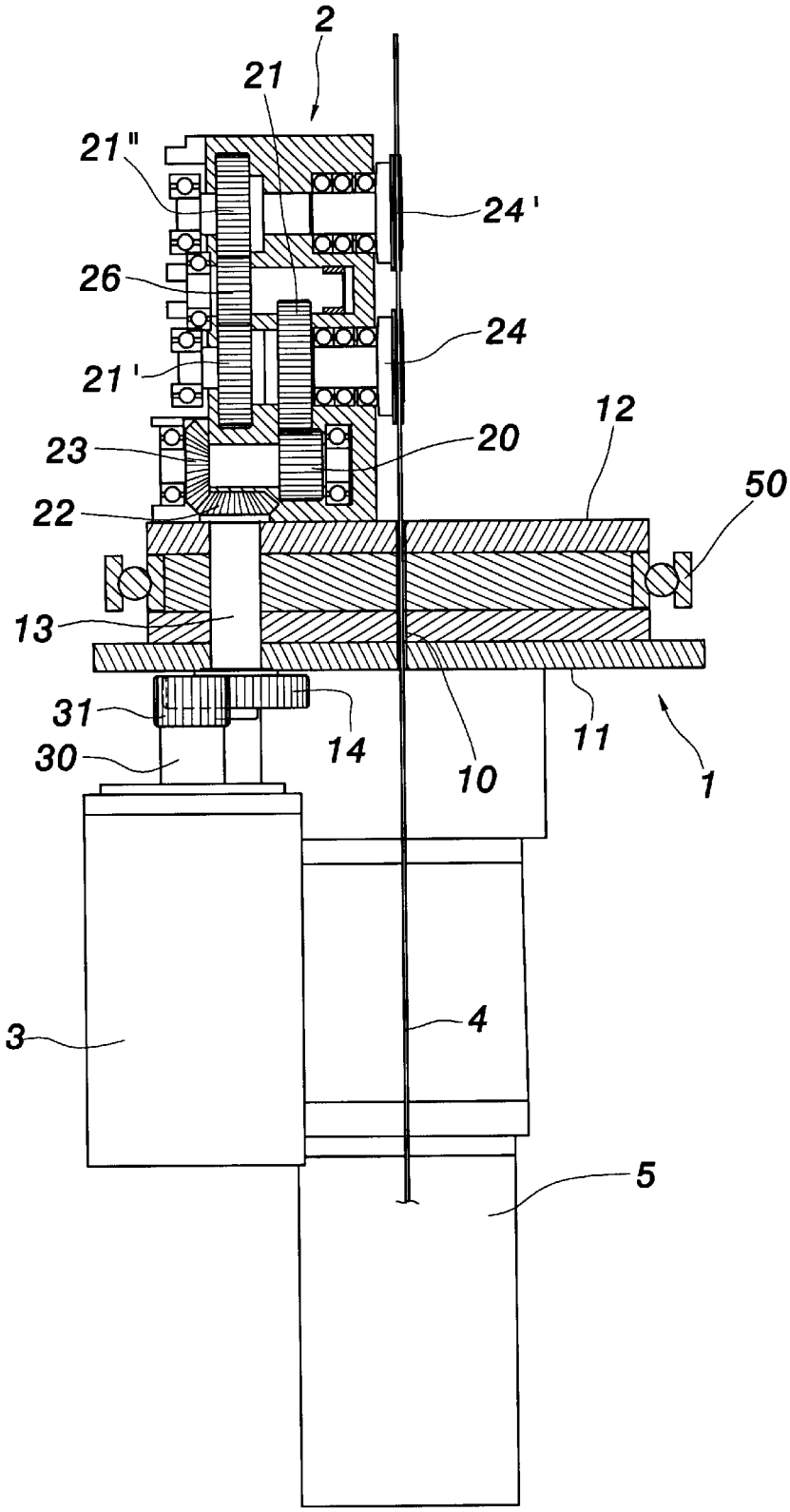
FIG. 3 is a top view in section of the preferred embodiment of the present invention.

Referring to FIGS. 1, 2, and 3, a transmission mechanism for spring winding machine is shown comprised of a rotary table 1, a wire feeding box 2, a wire feeding motor 3, and a wire winding motor 5.

The rotary table 1 is a flat circular member having a first side 11, a second side 12, a center wire passage hole 10 through the center of the first side 11 and the second side 12 for the passing of the spring wire 4 to be processed, a main shaft 13 eccentrically extended through the first side 11 and the second side 12, and a driven gear 14 mounted on the end of the main shaft 13 adjacent to the first side 11.

The wire feeding box 2 is fixedly mounted on the second side of the rotary table 1, comprising an intermediate gear 20, a spur gear 21, two meshed bevel gears 22;23, and a transfer cylinder set formed of a wire-transfer cylinder 24 and an impression cylinder 25 adapted for transferring the spring wire 4 to be processed through the center wire passage hole 10 of the rotary table 1. One bevel gear 22 is fixedly mounted on one end of the main shaft 13 adjacent to the second side 12 of the rotary table 1. The other bevel gear 23 is coaxially connected to the intermediate gear 20, which is meshed with the spur gear 21. The spur gear 21 is coaxially connected to the wire-transfer cylinder 24.

The wire feeding motor 3 is installed in the first side 11 of the rotary table 1, having a pinion 31 fixedly mounted on the output shaft 30 thereof and meshed with the gear 14 at the main shaft 13. Starting the wire feeding motor 3 to rotate the pinion 31, causes the main shaft 13 to rotate the wire-transfer cylinder 24, and therefore the spring wire 4 is delivered forwards for processing into springs.

The wire winding motor 5 is a reversible motor coupled to the rotary table 1 through a transmission belt 50, and controlled to rotate the rotary table 1 clockwise/counter-clockwise through 180°.

As indicated above, the pinion 31 of the wire feeding motor 3 is meshed with the gear 14 at the main shaft 13 for transmitting rotary driving force to the wire-transfer cylinder

24 to feed the spring wire 4 for processing into springs. This transmission arrangement requires less motor horsepower. Because the wire feeding motor 3 is installed in the rotary table 1, the transmission mechanism requires less installation space in the spring winding machine and, can easily be installed in the spring winding machine. Further, the wire feeding motor 3 and the wire winding motor 5 are operated independently, convenient for maintenance and program control. Therefore, it is not necessary to consider any compensation with respect to wire winding and feeding actions.

Referring to FIGS. 2 and 3 again, cylinders 24';25', spur gears 21';21" and an idle gear 26 between the spur gears 21';21" may be added to the transmission mechanism to efficiently deliver the spring wire 4 for processing. One of the spur gears 21';21" is coaxially connected to the wire-transfer cylinder 24'.

A prototype of transmission mechanism for spring winding machine has been constructed with the features of the annexed drawings of FIGS. 1~3. The transmission mechanism for spring winding machine functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A transmission mechanism used in a spring winding machine comprising:

a rotary table, said rotary table having a first side, a second side, a center wire passage hole through the center of said first side and said second side, a main shaft eccentrically extended through said first side and said second side, said main shaft having a first end protruding over said first side and a second end protruding over said second side, and a driven gear mounted on the first end of said main shaft;

a wire feeding box fixedly mounted on the second side of said rotary table, said wire feeding box comprising an intermediate gear, a transfer cylinder set formed of a wire-transfer cylinder and an impression cylinder adapted for transferring a spring wire through said center wire passage hole of said rotary table, a spur gear coaxially connected to said wire-transfer cylinder and meshed with said intermediate gear, a first bevel gear fixedly mounted on the second end of said main shaft, and a second bevel gear coaxially connected to said intermediate gear and meshed with said first bevel gear;

a wire feeding motor installed in the first side of said rotary table, said wire feeding motor having an output shaft and a pinion fixedly mounted on said output shaft and meshed with said driven gear at said main shaft; and a reversible wire winding motor coupled to said rotary table through a transmission belt and adapted for rotating said rotary table clockwise/counter-clockwise through 180°.

2. The transmission mechanism for spring winding machine as claimed in claim 1, wherein said wire feeding box further comprises at least one auxiliary cylinder set each formed of a wire-transfer cylinder and an impression cylinder and adapted for transferring the spring wire to be processed through said center wire passage hole of said rotary table, at least one pair of auxiliary spur gears, and at least one idle gear respectively meshed between the auxiliary spur gears of said at least one pair of auxiliary spur gears, one auxiliary spur gear of each of said at least one pair of auxiliary spur gears being coaxially connected to the wire-transfer cylinder of one of said at least one auxiliary cylinder set.

* * * * *